US009533426B2

(12) United States Patent
Horn et al.

(10) Patent No.: US 9,533,426 B2
(45) Date of Patent: Jan. 3, 2017

(54) PUNCH TOOL WITH A STAMP SUPPORTED IN A FLOATING MANNER

(71) Applicant: GROZ-BECKERT KG, Albstadt (DE)

(72) Inventors: Kuno Horn, Nusplingen (DE); Ernst Heinemann, Renquishausen (DE)

(73) Assignee: GROZ-BECKERT KG, Albstadt (DE)

( * ) Notice: Subject to any disclaimer, the term of this patent is extended or adjusted under 35 U.S.C. 154(b) by 281 days.

(21) Appl. No.: 13/845,383

(22) Filed: Mar. 18, 2013

(65) Prior Publication Data

US 2013/0220088 A1 Aug. 29, 2013

Related U.S. Application Data

(62) Division of application No. 12/847,259, filed on Jul. 30, 2010, now abandoned.

(30) Foreign Application Priority Data

Jul. 31, 2009 (EP) ..... 09167007

(51) Int. Cl.
*B26F 1/24* (2006.01)
*B26F 1/14* (2006.01)
(Continued)

(52) U.S. Cl.
CPC ..... *B26D 7/0006* (2013.01); *B26F 1/40* (2013.01); *B26D 2007/2607* (2013.01);
(Continued)

(58) Field of Classification Search
CPC ..... B26D 7/0006; B26D 2007/2607; B26F 1/40; B26F 1/14; B26F 1/04; Y10T 83/8878; Y10T 83/04; Y10T 83/4763; B21D 28/34; B23D 35/008; B22D 31/00
(Continued)

(56) References Cited

U.S. PATENT DOCUMENTS 2,703,143 A * 3/1955 Good et al. ..... 83/640
3,150,550 A * 9/1964 Berlin ..... B21D 37/205 29/465
(Continued)

FOREIGN PATENT DOCUMENTS

CN 101176896 A 5/2008
DE 4301200 7/1994
(Continued)

OTHER PUBLICATIONS

State Intellectual Property Office, P. R. China Second Office Action and English Translation; Mar. 26, 2013; 15 pgs.
(Continued)

*Primary Examiner* — Ghassem Alie
*Assistant Examiner* — Bharat C Patel
(74) *Attorney, Agent, or Firm* — Fitch, Even, Tabin & Flannery LLP

(57) ABSTRACT

For precise alignment of the punch stamps relative to the cutting plates, the respective punch stamp is supported in a floating manner, i.e., in a transversely movable manner, on the head plate associated with the punch stamp. The alignment of the cutting edges of the punch stamp with respect to the cutting edges of the cutting plate is accomplished by at least one stamp guide arrangement that is directly active between the punch stamp and the cutting plate and effects precise relative positioning in a direction transverse to the active cutting edges. The centering elements may extend from the punch stamp through the matrix or cutting plate. Alternatively, the centering elements may extend from the cutting plate through the openings of the punch stamp or extend along sliding or positioning surfaces of the punch stamp.

14 Claims, 7 Drawing Sheets

(51) Int. Cl.
*B26D 7/00* (2006.01)
*B26F 1/40* (2006.01)
*B26D 7/26* (2006.01)

(52) U.S. Cl.
CPC ..... *Y10T 83/04* (2015.04); *Y10T 83/4763* (2015.04); *Y10T 83/8878* (2015.04)

(58) Field of Classification Search
USPC ... 83/684–691, 699.31, 699.41, 133; 72/456, 448, 355.2
See application file for complete search history.

(56) References Cited

U.S. PATENT DOCUMENTS

| | | | | |
|---|---|---|---|---|
| 3,402,623 | A * | 9/1968 | Bennett | B21D 37/10 76/107.1 |
| 4,104,941 | A * | 8/1978 | Krueger | 83/133 |
| 4,277,994 | A * | 7/1981 | Gargrave | 83/133 |
| 5,144,709 | A * | 9/1992 | Rooney | 72/335 |
| 5,212,647 | A * | 5/1993 | Raney | B26D 5/007 348/95 |
| 5,253,559 | A * | 10/1993 | Philippe et al. | 83/133 |
| 5,517,910 | A * | 5/1996 | Skahan | 101/27 |
| 5,535,655 | A * | 7/1996 | Kammann | 83/559 |
| 5,794,526 | A * | 8/1998 | Raney | 100/39 |
| 6,095,307 | A * | 8/2000 | Hamulak et al. | 192/129 B |
| 6,246,922 | B1 * | 6/2001 | Korman et al. | 700/206 |
| 6,546,833 | B1 * | 4/2003 | Gifford et al. | 83/34 |
| 6,871,571 | B2 * | 3/2005 | Raney et al. | 83/76.8 |
| 6,883,410 | B2 * | 4/2005 | Kurita | B21D 35/00 83/220 |
| 7,121,178 | B2 * | 10/2006 | Halamoda et al. | 83/164 |
| 7,578,223 | B2 * | 8/2009 | Bliss | 83/532 |
| 7,640,836 | B1 * | 1/2010 | Raney | B26D 5/32 269/21 |
| 7,770,430 | B2 * | 8/2010 | Miceli | B21D 37/02 100/918 |
| 2003/0106400 | A1 * | 6/2003 | Lyons et al. | 83/13 |
| 2008/0110231 | A1 * | 5/2008 | Iwashita et al. | 72/456 |
| 2008/0282864 | A1 * | 11/2008 | Horn et al. | 83/549 |

FOREIGN PATENT DOCUMENTS

| | | | |
|---|---|---|---|
| DE | 102007046920 | | 4/2009 |
| JP | H10235436 | A | 9/1998 |
| JP | 2000153496 | A | 6/2000 |
| JP | 2003080494 | A | 3/2003 |
| JP | H0732298 | A | 3/2003 |
| JP | 2007007829 | A | 1/2007 |
| JP | 2008062283 | A | 3/2008 |
| JP | 2010036262 | A | 2/2010 |

OTHER PUBLICATIONS

Korean Notice of Preliminary Rejection dated May 17, 2012; Korean Application No. 10-2010-0072714; 8 pgs.
European Search Report, Related European Application No. EP09167007, dated Jan. 22, 2010, 4 pages.
Office Action in corresponding Chinese Application No. 201010277867.3, dated Aug. 30, 2012, 7 pages.
Supplementary Search in corresponding Chinese Application No. 201010277867.3, dated Mar. 17, 2013, 2 pages.
Japanese Search Report in corresponding Japanese Application No. 2010-171187, dated Jun. 25, 2014, 19 pages.
Office action in corresponding Japanese Application No. 2010-171187, dated Jun. 30, 2014, 7 pages.
Office action in corresponding Japanese Application No. 2010-171187, dated Jun. 8, 2015, 4 pages.

* cited by examiner

PUNCH TOOL WITH A STAMP SUPPORTED IN A FLOATING MANNER

CROSS-REFERENCE TO RELATED APPLICATIONS

This application is a divisional of U.S. application Ser. No. 12/847,259 filed Jul. 30, 2010, which application claims the priority of European Patent Application No. 09 167 007.5, filed Jul. 31, 2009, the subject matter of each which, in their entireties, are incorporated herein by reference.

BACKGROUND OF THE INVENTION

The present invention relates to a punch tool such as is used, for example, in a foil processing plant, for trimming the edge of a coated continuous foil.

Punch tools that are being moved are occasionally used in foil processing plants. The foil material that is provided in the form of a web is continuously advanced in a material advance direction. The punch tool comprises an upper tool and a lower tool, whereby the upper tool is arranged above the foil material and the lower tool is arranged below the foil material. In order to perform the punching operation, the closing punch tool is moved synchronously with the movement of the foil material with said foil material. After the punching stroke has been completed, the punch tool opens and is then again moved back into the home position. Consequently, the punch tool performs not only an opening and closing movement but, in addition, a back and forth movement in and against the foil transport direction or against the workpiece transport direction. In each instance, the punching unit moves for the duration of a punching operation with the passing foil. Thereafter, the punch tool returns in opened state into its original position in order to machine the next foil section.

Inasmuch as the punch tool is mounted to a support and is not rigidly connected to the machine frame but, rather, performs a continuous forward and reverse movement, the acceleration forces act on the punch stamp and the cutting plate, which may lead to inaccuracy problems. If thin and sensitive foils are to be punched and/or if particularly high demands are made on the accuracy of the punch cuts to be performed or on their quality, it can become difficult to ensure the required precision of the punching operation.

It is an object to remedy this and state measures by which, in particular in movably supported punch tools, high accuracy requirements can be met.

SUMMARY

The punch tool in accordance with the invention is particularly suitable for foil machining, in particular for machining thin metal sheets or metal foils. With the punch tool in accordance with the invention, it is possible to achieve high machining precision, even under difficult conditions, for example, due to the highest accuracy requirements, high punching speed, problematic foil materials and/or continuous back and forth movements of the punch tool or the like in longitudinal direction. For example, the foil material to be processed may be a foil as is used in high-power rechargeable batteries. The foil may be a copper foil coated with a cobalt/graphite mixture. The typical thickness may be, for example, at 0.2 mm, whereby the copper layer has a thickness of only 0.01 mm. Processing of this foil requires that extremely sharpened punch stamps be used and a very narrow cutting gap be maintained. This can be accomplished with the invention even if the punch tool, as described in the beginning, is moved along with the foil in order to perform the punching operation and is subsequently returned into its home position, i.e., in addition to its punching movement, said punch tool performs a back and forth movement in the foil transport direction.

The punch tool comprises at least one punch stamp that is movably connected on the head plate in at least one transverse direction oriented transversely to the punch stroke direction. The play existing between the punch stamp and the head plate disengages the transverse position of the stamp from the head plate. Consequently, the stamp is supported in a floating manner by the head plate. Positioning the stamp relative to the associate punch opening is now no longer performed by the frame but by the stamp guide arrangement that is directly active between the punch stamp and the cutting plate. In this manner, extremely precise relative positioning can be accomplished between the stamp and the cutting plate, i.e., independently of the acceleration or deceleration forces acting on the stamp or the cutting plate due to the continuous back and forth movement of the entire punch tool in the direction of transport of the workpiece. Therefore, high precision can be achieved even at high operating speeds. However, it is being pointed out that the invention is suitable for the use of punch tools that are being moved and also of punch tools that are non-moving, if extremely high precision is to be achieved. Also, it is possible to support the stamp or stamps on the head plate in a rigid manner and to support the cutting plate or cutting plate sections so as to be movable in transverse direction relative to the stamp. Again, the stamp guide arrangement effects the precise relative alignment of the stamp and of the cutting plate or their cutting edges.

Preferably, the punch stamp is movably supported in a transverse direction oriented transversely to the workpiece transport direction. To do so, the punch stamp may be held in a sliding guide. If the edges of a passing material web or another workpiece are to be trimmed, two stamps supported in a floating manner independently of each other may be provided at the appropriate points of the punch tool, each of said stamps being movably held in said transverse direction, i.e., they may display (transverse) clearance. The stamp guide arrangements of the two stamps guide the stamps on the cutting plate and thus ensure the proper interplay between the respective stamp and the respective punch opening, and, in addition, also ensure the precise maintenance of the distance of the two cutting edges produced by the stamp(s) on the workpiece.

Preferably, the punch tool comprises passage openings on two opposite sides, whereby the web-shaped workpiece may enter and exit the punch tool through said passage openings. Preferably, the stamp guide arrangements are arranged laterally next to the passing web-shaped workpiece, i.e., outside a workpiece passage space. This enables the continuous engagement of the stamp guide arrangement. Said stamp guide arrangement may be configured as a linear guide, for example. The linear guide may be made of one or more round bolts that have a polygonal, rectangular or differently shaped cross-section, said bolts coming into engagement with the corresponding guide openings. For example, the bolt or bolts may be provided on the stamp, and the guide opening or openings may be provided on the cutting plate. It is pointed out that this arrangement may also be reversed, i.e., the guide bolts may be arranged on the cutting plate, and the associate or respectively allocated guide openings may be arranged on the respective stamp. This applies to both the embodiment comprising the movable stamp and the stationary cutting plate and also to the embodiment comprising the stationary stamp and the movable cutting plate. However, in any event, it is preferred that the guide bolts and the guide openings be left in continuous engagement. In other words: Preferably, the guide bolts are longer than the punch stroke of the punch tool. In addition, the guide bolt in the guide opening preferably acts not only as a transverse guide but, if desired, also as tilting guide. In other words: Preferably, the guide arrangement has only one degree of freedom, this being the movement in punch stroke direction.

In other words: The stamp guide arrangement is a linear guide arrangement whose guiding direction coincides with the punching direction. In view of the precision that is to be achieved, the play of the linear guide arrangement is to be kept as minimal as possible.

The guide bolt or any other guide bodies of the linear guide arrangement may be an integral part of the punch stamp, i.e., may be seamlessly made of the same material as said punch stamp. However, it is preferred that the guide body or guide bodies be designed as separate elements that are permanently connected with the stamp, for example, by being soldered, welded or screwed thereto.

Additional details of advantageous embodiments of the invention are the subject matter of the claims as well as the drawings and/or the description. In so doing, the description is restricted to the representation of an exemplary embodiment of the invention that indicates the inventive features and other details. The drawings are to be considered as a supplementary reference. A deviation from the embodiment is possible within the scope of the patent claims.

DETAILED DESCRIPTION

Figure 1:
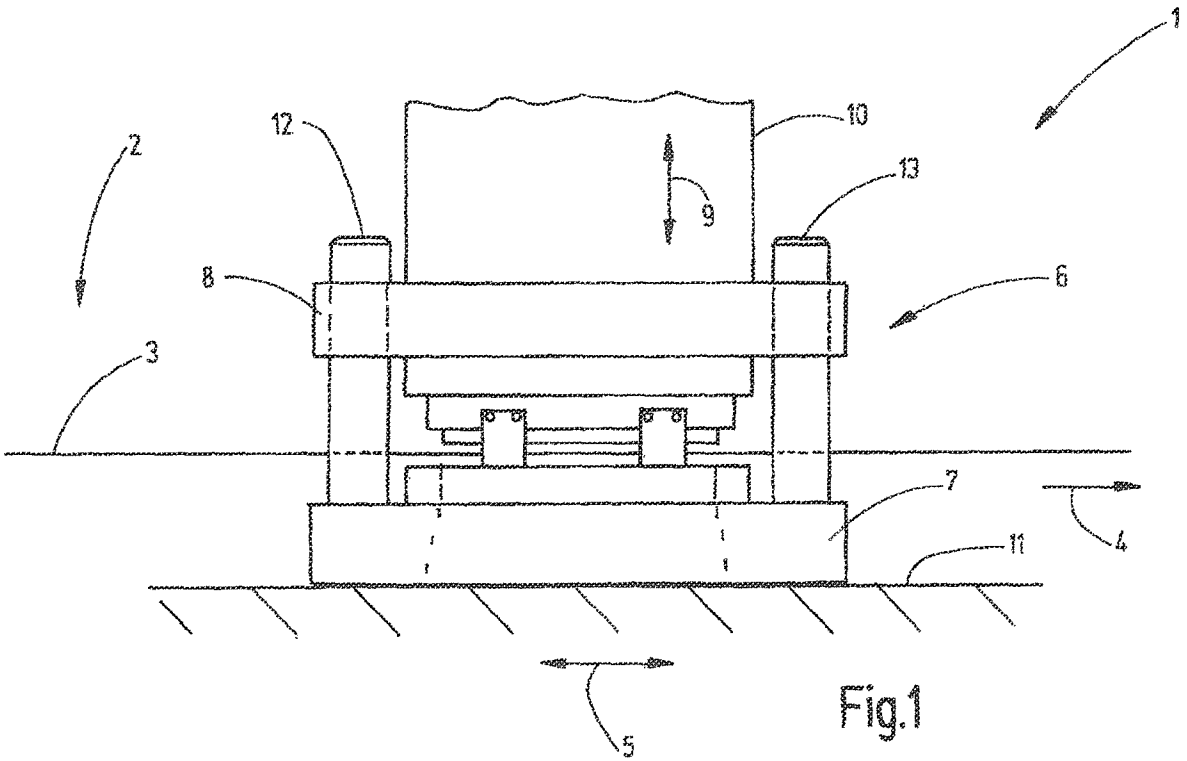
FIG. 1 is a schematic side view of the punch tool in accordance with the invention.

FIG. 1 shows a punch tool 1 that is used for punching out pre-specified contours or, as is preferably the case, is set up for trimming the longitudinal edges of a passing continuous workpiece 2, said workpiece having the form of a foil material 3, for example. This may be a non-metallic foil, a metal foil, a foil consisting of a single material or a foil composed of several different materials, for example, a multi-layer foil. For example, the foil may be a laminated foil consisting of layers of copper, cobalt and graphite or of a mixture of cobalt and graphite.

The workpiece 2 is preferably continuously moved through the punch tool 1 at a constant speed by not specifically illustrated transport means in a workpiece transport direction 4 indicated by an arrow. In so doing, the punch tool 1 performs punching operations on the workpiece 2, for example for trimming one or more edges, for example the longitudinal edges. To do so, as is indicated by an arrow 5, the punch tool 1 is moved along with the workpiece 2 in workpiece transport direction 4 for the duration of the punching operation. If, as opposed to this, the punch tool 1 is open, the punch tool 1 can be moved back into its home position against the workpiece transport direction 4, whereupon the same cycle of operation begins anew. In so doing, the punch tool 1 performs a back and forth movement parallel to the workpiece transport direction 4.

The means for moving the punch tool in and against the workpiece transport direction 4 and for opening and closing the punch tool are not shown in FIG. 1. This relates to an appropriately equipped punching machine that opens and closes the punch tool and is additionally able to impart the above-described advance and retraction movement.

The punch tool 1 comprises a frame 6 that includes a base plate 7 and a head plate 8. The head plate 8 can be moved relative to the base plate, i.e., toward said base plate and away there from, in a punch stroke direction 9 that is indicated by an arrow in FIG. 1. The head plate 8 is connected with a ram of the not specifically illustrated punch press or a corresponding machine part 10, so that the head plate 8 is imparted with the appropriate relative movement with respect to the base plate 7. In contrast, the base plate 7 is supported on a support 11 that is immovable relative to the punch stroke direction 9, however, said support being additionally movable like the machine part 10, as indicated by arrow 5. The movement relationships may also be reversed, i.e., the stamps may be stationary, and the cutting plate may be arranged so as to be movable in punch stroke direction 9.

Preferably (but not necessarily) the guide columns 12, 13, 14, 15 (see also FIGS. 2 and 3) extend upward from the base plate 7, said guide columns acting as guides for the head plate 8. To do so, said head plate has matching guide openings which enable it to slide on the guide columns 12 through 15.

Figure 2:
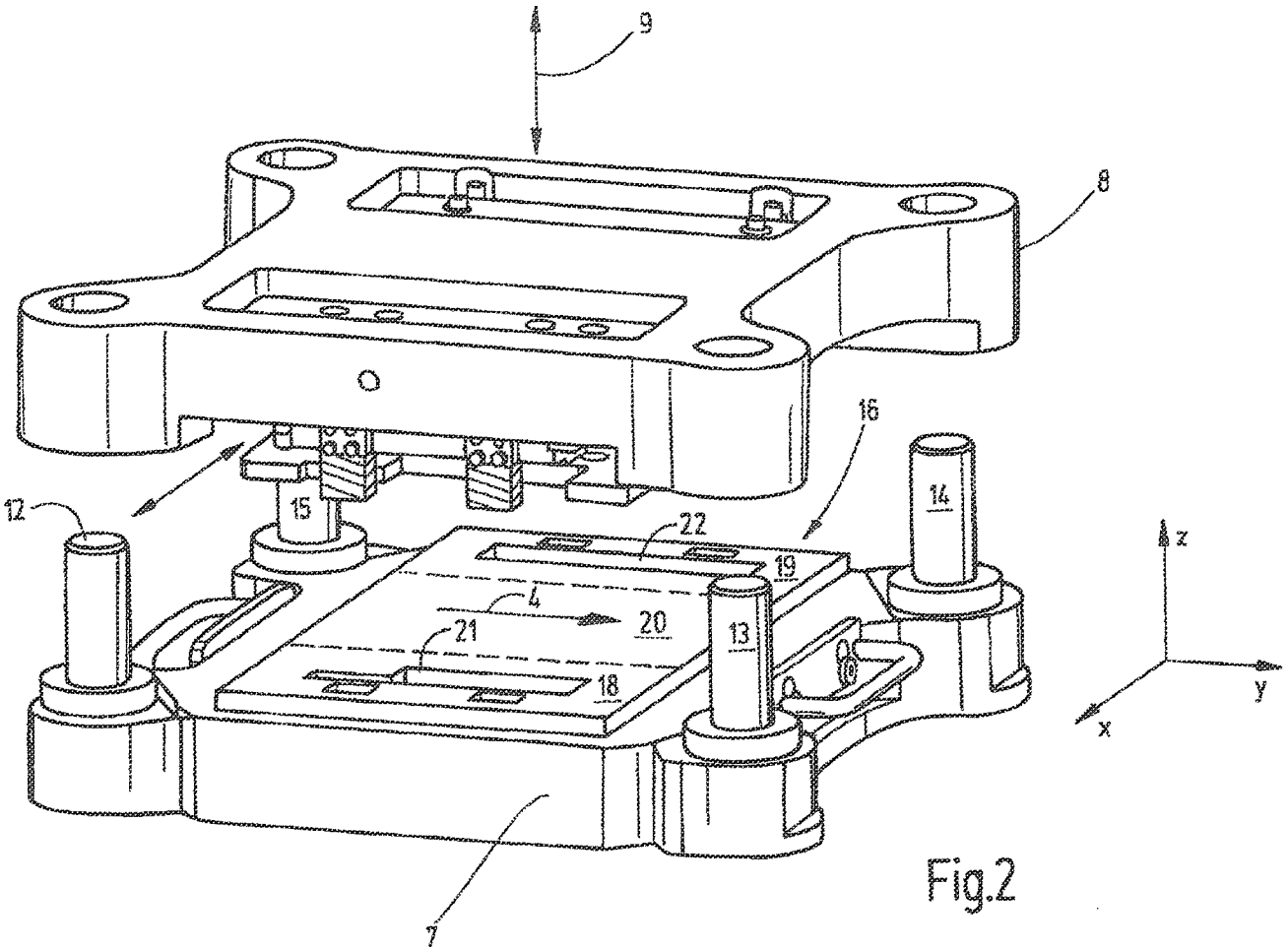
FIG. 2 is a slightly more detailed perspective exploded view of the punch tool in accordance with FIG. 1.
Figure 3:
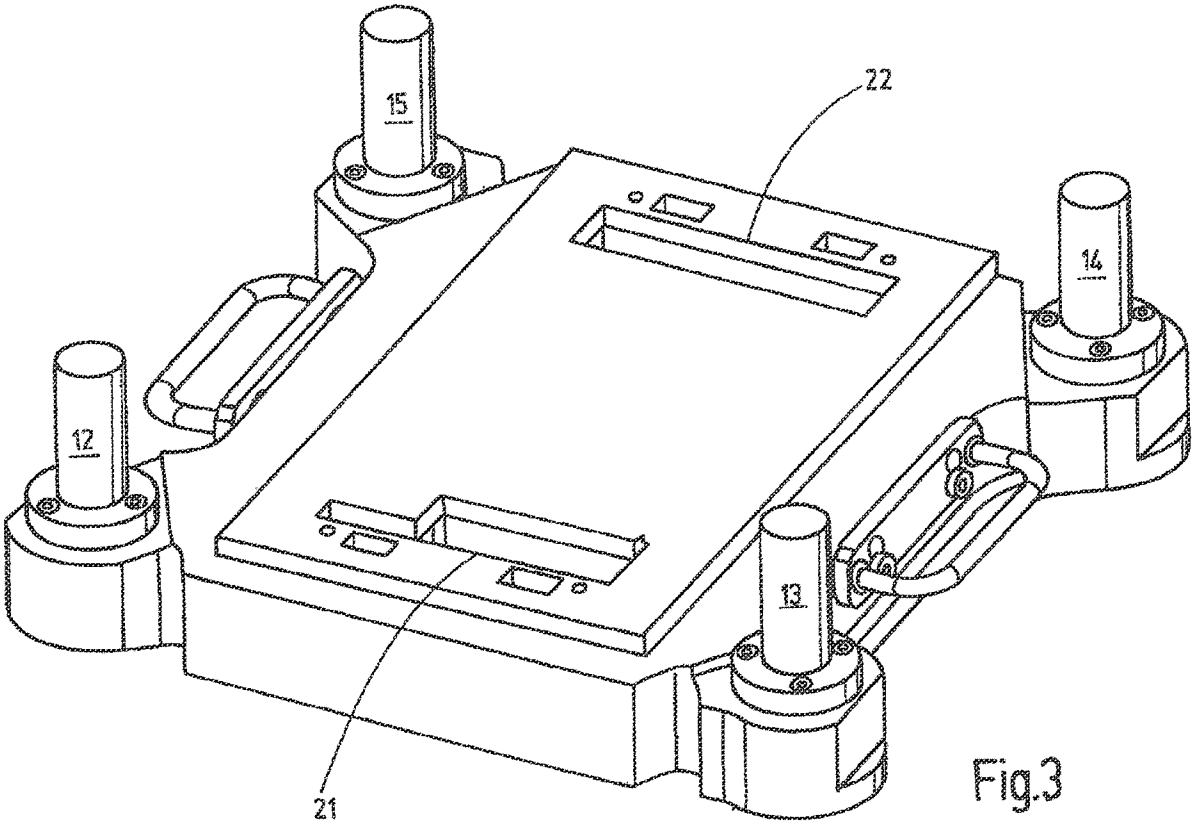
FIG. 3 is a perspective representation of the lower part of the punch tool in accordance with FIG. 2.

The base plate 7 supports a cutting plate 16 (FIG. 2). This cutting plate is preferably rigidly connected with the base plate 7. Alternatively, this guide plate 16 may also be configured so as to be a part of the base plate 7. The cutting plate 16 may consist of one piece. However, it is preferred that the cutting plate 16 be divided into different components, i.e., a first cutting plate 18 associated with one edge of the workpiece 3, a second cutting plate 19 associated with the opposite edge, and an interposed support plate 20 acting as a support for the workpiece 3. Preferably, the cutting plates 18, 19 and the support plate 20 each has a flat upper side located in one plane. The butt joints between the cutting plates 18, 19 and the support plate 20 are shown in dashed lines in FIG. 2.

In addition, the cutting plates 18, 19 comprise punch openings 21, 22 having a contour following the desired punch contour. In the embodiment in accordance with FIG. 2, the two punch openings 21, 22 have an elongated form and are oriented parallel to the workpiece transport direction 4. However, the form of the punch openings may also be selected differently, for example, in order to produce different punch contours.

Figure 4:
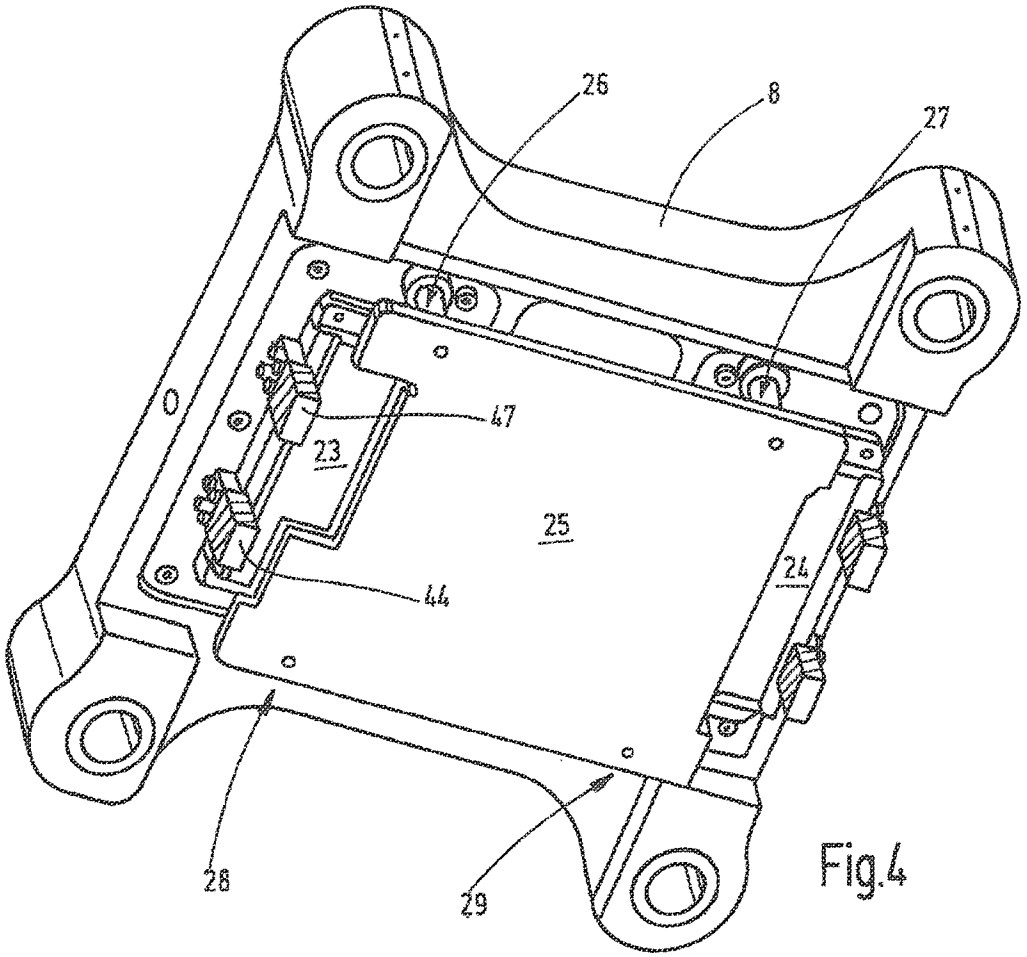
FIG. 4 is a separate perspective representation of the upper part of the punch tool in accordance with FIG. 2.

The punch openings 21, 22 are associated with punch stamps 23, 24 that are obvious from FIG. 4, for example. These punch stamps 23, 24 are held on the head plate 8. They have an active contour matching the punch openings 21, 22 and may immerse into the punch openings 21, 22 with said contour. In so doing, said openings—together with the punch openings 21, 22 of the cutting plate—define extremely tight, precise cutting gaps.

As is also shown by FIG. 4, a holding-down plate 25 may be arranged between the punch stamps 23, 24, in which case their preferably flat underside is disposed to press the foil or the other workpiece 2 against the cutting plate 16, i.e., the cutting plates 18, 19, and the support plate 20 during the punching operation. To do so, the holding-down plate 25 is supported by the corresponding guides 26, 27, 28, 29 so as to be shiftable in punch stroke direction 9 and is biased by suitable spring means toward the cutting plate 16. The holding-down plate 25 is provided with openings or edge-side recesses whose contour is adapted to the punch stamps 23, 24.

Figure 6:
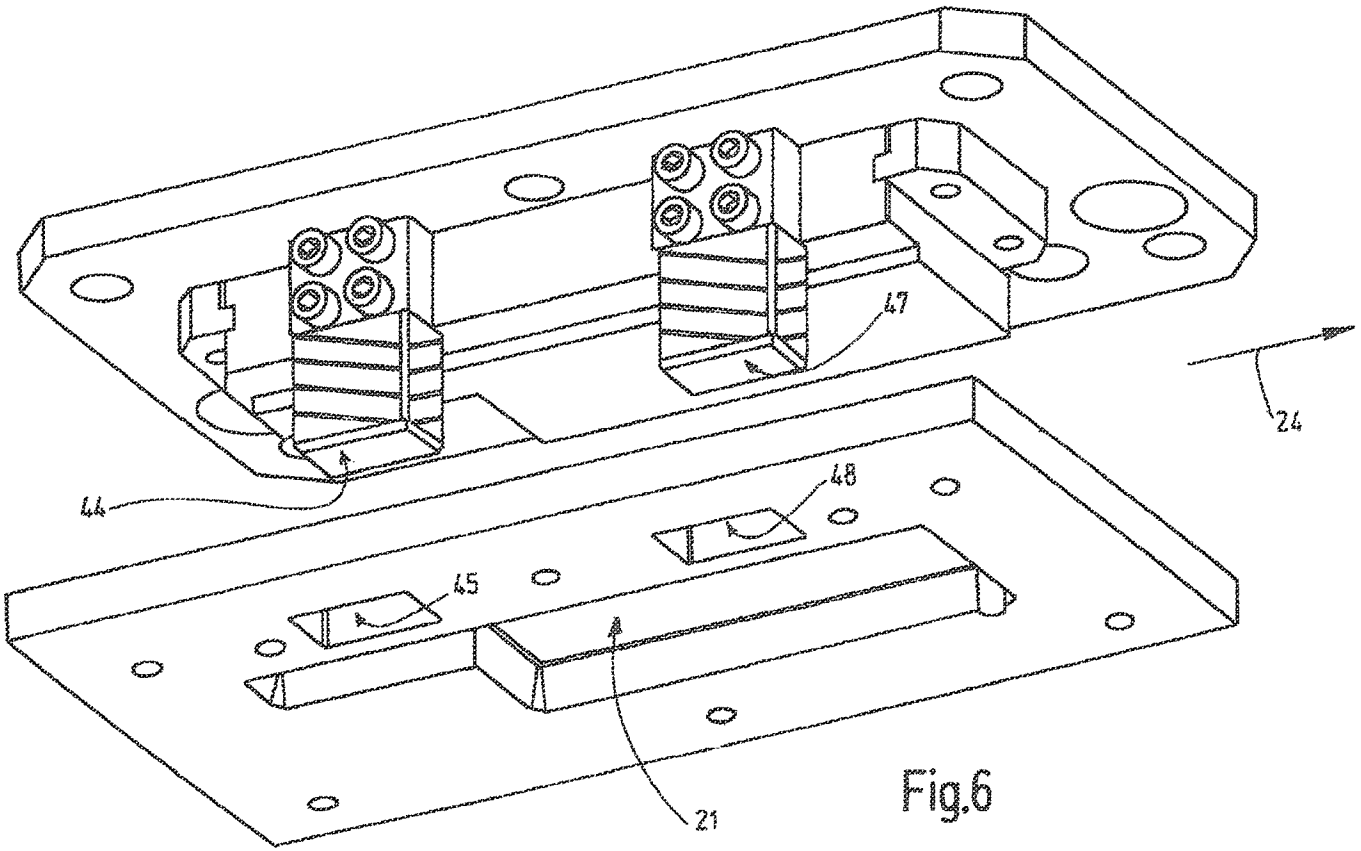
FIG. 6 is another perspective exploded view of the cutting plate and the punch stamp in accordance with FIG. 5.
Figure 7:
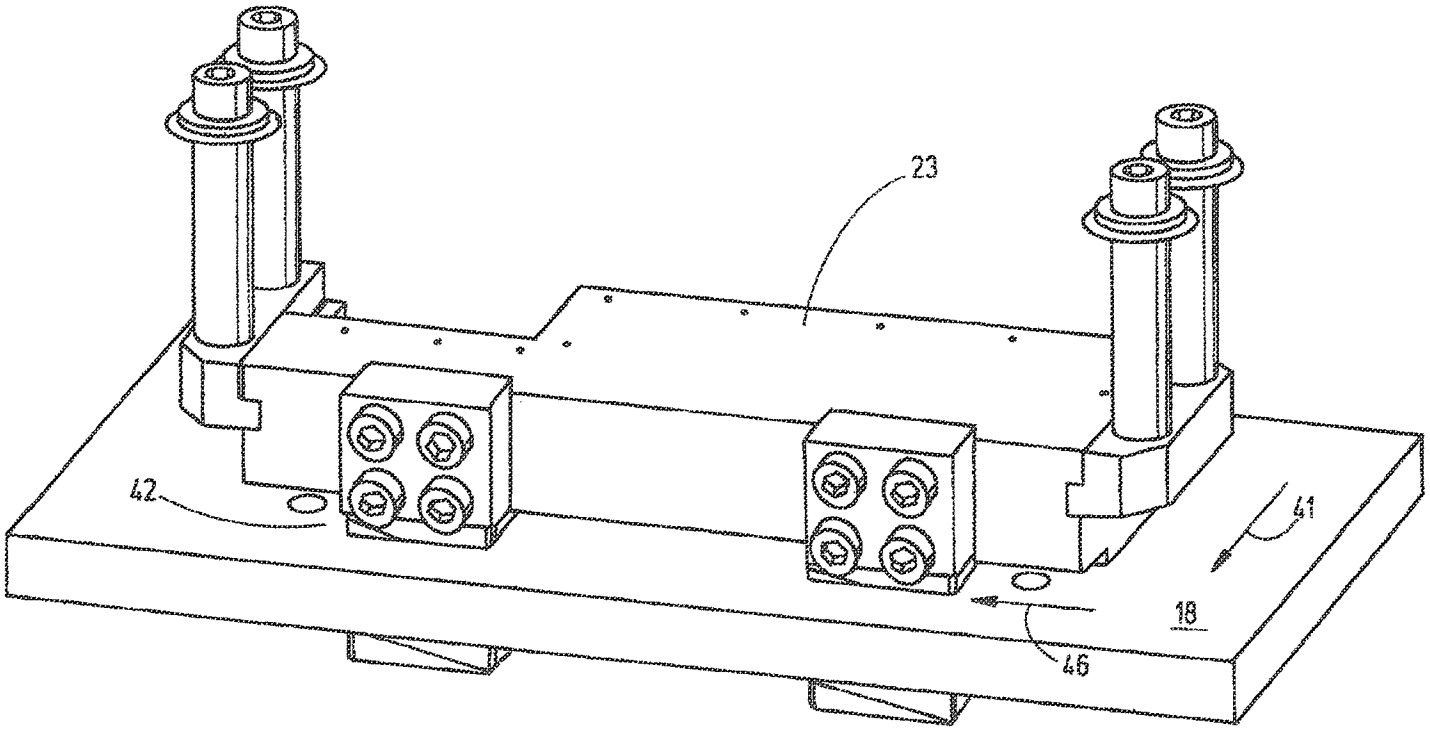
FIG. 7 shows the cutting plate and the punch stamp in accordance with FIGS. 5 and 6, in engagement.

The punch stamps 23, 24 are supported in a floating, i.e., laterally movable, manner as will be explained hereinafter with reference to FIGS. 5, 6 and 7 and with reference to the punch stamp 23 shown there in conjunction with the cutting plate 18. However, the description hereinafter also applies analogously to the punch stamp 24 and the cutting plate 19.

The punch stamp 23 is held on two oppositely arranged sides 56, 57 in the sliding guides 58, 59. These comprise sliding pieces 30, 31 that are screwed tightly to the head plate 8 by means of bolts 32, 33, 34, 35 shown in FIG. 5. Each of the sliding pieces 30, 31 has a guide rib 36, 37. The two guide ribs 36, 37 extend parallel to each other and face each other. They are arranged at a defined distance from the head plate 8 and come into engagement with grooves 38, 39 that are provided in the end surfaces on the sides 56, 57 of the punch stamp 22. The ribs 36, 37 have minimal clearance in the grooves 38, 39. This clearance may be provided in X-direction as well as in Y-direction. In addition, the distances of the ribs 36, 37 and the grooves 38, 39 from the head plate match each other in such a manner that the upper, preferably flat, pressure surface 40 of the punch stamp 23 may abut against the head plate 8, without being biased by the sliding pieces 30, 31 against the head plate 8. In so doing, the punch stamp 23 displays mobility in the transverse direction 41, said direction being oriented in a direction transverse to the workpiece transport direction 4, and, in addition, displays mobility in the workpiece transport direction 4. For clarification, the corresponding directions are shown in FIG. 5. Generally, for clarification, it applies that the workpiece transport direction 4 can be viewed as the Y-direction, and the transverse direction 41 can be viewed as the X-direction. The punch stroke direction 9 represents a Z-direction. X, Y and Z form a Cartesian coordinate system; they are positioned in pairs at a right angle with respect to each other.

Optionally, the sliding guides 58, 59 may provide not only a sliding mobility in X-direction (transverse direction 41) but, if desired, also mobility in Y-direction (workpiece transport direction 4). The sliding guides 58, 59 may also be matched to each other and to the punch stamp 23 in such a manner that a sliding mobility is given only in one given direction, e.g., the transverse direction 41.

At least one stamp guide arrangement 42 is provided for the alignment of the punch guide 23 relative to the cutting plate 18, said stamp guide arrangement potentially being a linear guide 43 or also being means that act in the same manner. In the present exemplary embodiment, the linear guide 43 comprises a guide body 44 and a guide opening 45. In the present exemplary embodiment, a second stamp guide arrangement 46 is provided, said stamp guide arrangement again being a linear guide and comprising a guide body 47 as well as a matching guide opening 48.

Figure 5:
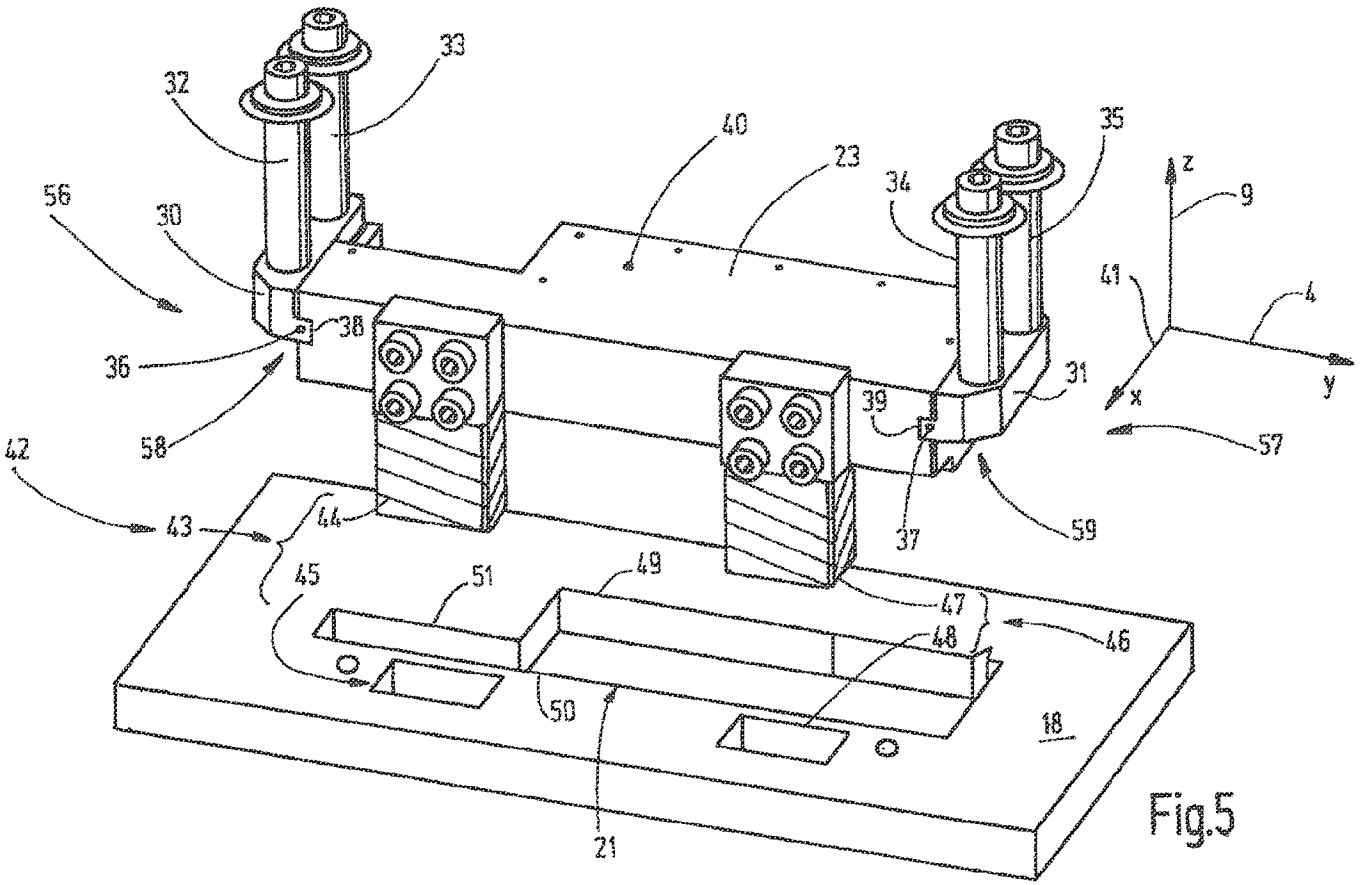
FIG. 5 is a perspective exploded view of the cutting plate and the punch stamp of the punch tool in accordance with FIG. 2.

FIG. 5 is an exploded view of the two stamp guide arrangements 42, 46. This is also shown by the exploded representation of FIG. 6. As is obvious, the two guide bodies 44, 47 are disposed to be rectangular bolts. The guide openings 45, 48 are matching rectangular openings, preferably having a constant cross-section. Preferably, the guide bodies 44, 47 are screwed to the punch stamp 23. The guide openings 45, 48 are preferably arranged in the immediate vicinity of the punch opening 21.

Each of the guide bodies 44, 47 that are rectangular in cross-section in the example, comprise at least two guide surfaces, each being preferably oriented parallel to the workpiece transport direction 4 (Y-direction). Consequently, these surfaces are preferably located in the Y-Z-plane. Corresponding guide surfaces are provided in the guide openings 45, 48. As is especially obvious from FIG. 7, the punch stamp 23 is guided by the stamp guide arrangements 42, 46 with respect to the transverse direction 41 relative to the cutting plate 18 and its punch opening 21.

In the present exemplary embodiment, the cutting edges of the cutting plate 17 essential for machining precision are the edges 49, 50, 51 of the punch openings 21, said edges being oriented parallel to the workpiece transport direction 4 (FIG. 5). The punch stamp 23 is supported in a floating, i.e., shiftable, manner in a direction transverse to these edges 49 through 51. The stamp guide arrangements 42, 46 position the punch stamp 23 in particular with respect to this direction, transversely with respect to the edges 49, 50, 51.

Expressed in general terms, the stamp guide arrangement 42 and, optionally, also the stamp guide arrangement 46 (if present) is configured so as to precisely position the punch stamp that is supported in a floating manner in a direction transverse to the edge or edges of the punch opening 21, at which the desired machining precision and a very narrowly defined cutting gap are to be adjusted. If the respective precision-defining cutting edge of a punch opening is inclined, for example, in the X-Y-direction, the punch stamp 23 is again supported so as to be shiftable in transverse direction, preferably at a right angle, relative to this edge, whereby the position of said punch stamp is then defined in a precise manner relative to the cutting edge by the stamp guide arrangement.

The length of the guide bodies 44, 47 is such that said guide bodies will not move out of their associate guide openings 45 48, i.e., neither during the punch stroke nor during the return stroke. Alternatively, the guide bodies 44, 47 may also be shorter and emerge from the guide openings 45, 48, in particular when said guide bodies must clear the way for a workpiece. In that case, said guide bodies have insertion aids on their front side, for example in the form of suitable inclined surfaces. In addition, the guide bodies 44, 47, as indicated in the figures, may be provided with lubricating grooves that extend around the circumference of the guide bodies 44, 47. Alternatively or supplementally, the guide openings 45, 48 may be provided with lubricating grooves.

The punch tool described so far works as follows:

During operation, the head plate 8 continuously performs an up and down movement in punch stroke direction 9. During the downward stroke, the punch tool 1 is moved synchronously with the workpiece 2 in workpiece transport direction 4. The punch stamps 23, 24 immerse into the cutting plate 18, 19 and thus perform the desired punching operation. Positioning of the punch stamps 23, 24 transversely with respect to the respectively active cutting edges, in FIG. 5 the cutting edges 49, 51 (and optionally 50), is carried out by the stamp guide arrangements 42, 46 directly with respect to the respective cutting plate 18 (and correspondingly, 19). Potential guiding inaccuracies of the head plate, said inaccuracies originating from the columns 12 through 15, do not influence the precision of the punching operation. Consequently, the cutting gaps can be adjusted with an accuracy that is substantially greater than the accuracy provided by the frame 6.

For precise alignment of the punch stamps relative to the cutting plates, the respective punch stamp 23 is supported in a floating manner, i.e., in a transversely movable manner, on the head plate 8 associated with said punch stamp. The alignment of the cutting edges of the punch stamp with respect to the cutting edges 49, 50, 51 of the cutting plate 18 is accomplished by at least one stamp guide arrangement 42 that is directly active between the punch stamp 23 and the cutting plate 18 and effects precise relative positioning in a direction transverse to the active cutting edges. The stamp guide arrangement 42 comprises centering elements with a cross-section having a contour, said contour being, for example, rectangular, cylindrical or polygonal.

The centering elements may extend from the punch stamp 23 through the matrix or cutting plate 18. Alternatively, the centering elements may extend from the cutting plate 18 through the openings of the punch stamp 23 or extend along sliding or positioning surfaces of said punch stamp.

It will be appreciated that the above description of the present invention is susceptible to various modifications, changes and modifications, and the same are intended to be comprehended within the meaning and range of equivalents of the appended claims.

LIST OF REFERENCE NUMERALS

1 Punch tool
2 Workpiece
3 Foil
4 Workpiece transport direction
5 Arrow
6 Frame
7 Base plate
8 Head plate
9 Punch stroke direction
10 Machine part
11 Support
12-15 Guide columns
16, 18, 19 Cutting plate
20 Support plate
21, 22 Punch openings
23, 24 Punch stamp
25 Holding-down plate
26, 27, 28, 29 Guides
28, 29 Sliding guides
30, 31 Sliding pieces
32-35 Bolts
36, 37 Ribs
38, 39 Grooves
40 Pressure area
41 Transverse direction
42, 46 Stamp guide arrangement
43 Linear guide
44, 47 Guide body
45, 48 Guide opening
49-51 Edges
56, 57 Sides
58, 59 Sliding guide

What is claimed is:

1. A punch tool apparatus comprising:

a frame including a base plate and a head plate, the head plate being supported so as to be movable, relative to the base plate, toward the base plate and away from the base plate in a punch stroke direction, at least one punch stamp, the punch stamp being connected with the head plate by at least two sliding guides including at least one guide rib and groove arrangement that provides mobility between the punch stamp and both the head plate and the cutting plate in at least one transverse direction oriented transversely to the punch stroke direction, a cutting plate, the cutting plate being provided in or arranged on the base plate, and a stamp guide arrangement that is active between the cutting plate and the at least one punch stamp, the stamp guide arrangement comprising at least one linear guide arranged between the cutting plate and the punch stamp and configured to be in continuous engagement through the at least one linear guide's range of motion during continuous relative back and forth movement between the punch stamp and the cutting plate across consecutive stamping operations and to effect alignment between the punch stamp and the cutting plate via the mobility provided there between.

2. The punch tool apparatus of claim 1, the transverse direction, in which the punch stamp can be moved, is oriented in a direction transverse to a workpiece transport direction, whereby a preferably web-shaped workpiece moves through the punch tool in the workpiece transport direction or moves in a direction oriented transversely to a cutting edge of the cutting plate.

3. The punch tool apparatus of claim 1, wherein the transverse direction, in which the punch stamp has play, is oriented so as to be inclined or parallel to a workpiece transport direction in which a preferably web-shaped workpiece moves through the punch tool.

4. The punch tool apparatus of claim 1, wherein the punch stamp is connected with the head plate so as to be movable in two transverse directions that are oriented transversely to the punch stroke direction.

5. The punch tool apparatus of claim 1, wherein the frame is open on two opposite sides in a workpiece transport direction.

6. The punch tool apparatus of claim 5, wherein the stamp guide arrangement is arranged at a distance from the punch stamp in a direction transverse to the workpiece transport direction.

7. The punch tool apparatus of claim 1, wherein each punch stamp, independent of potentially available additional punch stamps, is movably connected with the head plate in at least one transverse direction, the direction being oriented transversely to the punch stroke direction.

8. The punch tool apparatus of claim 1, wherein each punch stamp is individually associated with one stamp guide arrangement.

9. The punch tool apparatus of claim 1, wherein the punch stamp is associated with several stamp guide arrangements.

10. The punch tool apparatus of claim 1, wherein the linear guide comprises at least one guide body, the guide body extending through a guide opening.

11. The punch tool apparatus of claim 10, wherein the guide body has guide surfaces arranged on at least two opposite sides of the guide body, the guide surfaces being associated with sliding surfaces in the guide opening.

12. The punch tool apparatus of claim 10, wherein the guide opening is provided in the cutting plate, and that the guide body is arranged on the punch stamp.

13. The punch tool apparatus of claim 10, wherein the guide body has guide surfaces that are longer than a punch stroke of the punch stamp.

14. The punch tool apparatus of claim 10, wherein the guide body has a length such that the guide body will not move out of the guide opening during a punch stroke and a return stroke of the punch stamp.

* * * * *